US005284294A

United States Patent [19]

Floyd

[11] Patent Number: 5,284,294

[45] Date of Patent: Feb. 8, 1994

[54] DISPOSABLE COOLER

[76] Inventor: Roy V. Floyd, 1214 Meadowood Dr., Shelby, N.C. 28150

[21] Appl. No.: 891,559

[22] Filed: May 29, 1992

[51] Int. Cl.[5] ..... B65D 5/24

[52] U.S. Cl. ..... 229/179; 229/147; 229/117.15; 229/151; 229/186

[58] Field of Search ..... 229/147, 149, 151, 178, 229/179, 186, 117.13, 117.14, 117.15

[56] References Cited

U.S. PATENT DOCUMENTS

| | | | |
|---|---|---|---|
| 921,197 | 5/1909 | Zell . | |
| 1,150,105 | 8/1915 | Emmons . | |
| 1,700,758 | 2/1929 | Berkowitz . | |
| 2,151,472 | 3/1939 | Hubbard . | |
| 2,364,267 | 12/1944 | Buttery | 229/147 |
| 2,419,646 | 4/1947 | Inman | 229/147 |
| 2,721,022 | 10/1955 | Billerbeck . | |
| 2,874,870 | 2/1959 | Collura . | |
| 3,112,058 | 11/1963 | Martin | 229/151 X |
| 3,131,849 | 5/1964 | Paige | 229/179 X |
| 3,172,769 | 3/1965 | Horan . | |
| 3,246,829 | 4/1966 | Sexton | 229/179 X |
| 3,310,219 | 3/1967 | Dlugopolski | 229/147 X |
| 3,346,167 | 10/1967 | Schmidt . | |
| 3,826,420 | 7/1974 | Bamburg et al. | 229/178 X |
| 4,119,265 | 10/1978 | Dlugopolski | 229/186 X |
| 4,168,028 | 9/1979 | McCall | 229/147 |
| 4,558,815 | 12/1985 | Wischusen, III | 229/186 X |
| 4,728,025 | 3/1988 | Oliff . | |
| 4,785,991 | 11/1988 | Schuster . | |
| 4,949,900 | 8/1990 | Ballu | 229/179 X |
| 5,065,939 | 11/1991 | Boothe et al. | 229/151 |

*Primary Examiner*—Gary E. Elkins
*Assistant Examiner*—Christopher J. McDonald
*Attorney, Agent, or Firm*—Dority & Manning

[57] ABSTRACT

A disposable container is made from an integral blank of corrugated cardboard for folding between a relatively flat configuration for storage and a set-up configuration for receiving articles. A bottom wall is foldably attached to two pairs of side walls. The side walls are joined by four pleated walls to form a seamless interior portion when the walls are raised into a set-up configuration perpendicular to the bottom wall. The side and pleated walls include user-friendly self-locking elements for securing the set-up configuration. A moisture barrier coating on the interior permits ice and perishables to be received in the seamless interior portion to provide a disposable insulated cooler. A pair of folding top walls provide handles. One of the top walls includes a locking panel with lateral locking tabs which fold down across the top of the set-up cooler so that the closure locking tabs are seated in respective planar slots formed by the raised walls for positively closing the cooler interior. The disposable cooler may be variously sized, such as to accommodate ice combined with 6 or 12 drink cans. When preloaded with desired articles, a plastic shrink wrap may be applied to the exterior of the set-up cooler.

18 Claims, 5 Drawing Sheets

DISPOSABLE COOLER

BACKGROUND OF THE INVENTION

The present invention pertains in general to a foldable container and in particular to a disposable cooler comprising an integral blank of containerboard foldable between a relatively flat configuration for storage and a set-up configuration for receiving articles.

In the field of transporting materials, generally there is a concern for minimizing weight while safely transporting the subject articles. When considering transportation containers themselves, the specific concerns are for minimizing the weight of the container while at the same time providing a container which is adequately strong and stable to receive and support the articles or goods of interest. The nature of such articles (for example, liquid verses solid) and their bulk and weight can make for certain required parameters for any container intended to handle specific items.

In general, the fewer materials utilized in fabricating a given container, the lower the weight of such container, as desired. However, it is also true, generally speaking, that the use of fewer materials can mean a less strong container.

One major approach to minimizing container weight while still providing adequate strength has been the use of boxes or similar receptacles constructed from containerboard, such as cardboard. Corrugated cardboard is widely known and used for added strength. Corrugated cardboard is a multiple layer product, such as opposing face layers glued to a fluted layer of cardboard or a heavy gauge paper therebetween. The size of the fluting may be varied to certain industry standards (e.g., A, B, C, or D size fluting) to achieve different thicknesses and different strength ratings.

Frequently, boxes or containers for products to be shipped or otherwise processed are formed or fabricated in a substantially permanent set-up or fixed configuration which is held together and sealed by staples, tape, glue, and/or other methods of closure. Upon arrival at the intended designation, such boxes must then be cut or otherwise opened in a manner such that reuse or reclosure is not intended or not possible without further staples, tape, etc. Once delivery of the subject articles is complete, such fixed form boxes are often "ripped" or cut down for folding or they are otherwise reduced to a relatively flat form to be discarded or to be hauled away for recycling or processing.

Certain specific transportation and/or handling needs have been heretofore addressed by specialized containers or carriers which may be folded from an initially relatively flat piece or pieces of material such as cardboard. Such pieces to be folded are generally referred to as blanks, and the folding process may either be substantially permanent (in which case the boxes would not be intended to be again unfolded) or it may be reversible (in which case the boxes would intend to be reclosed and reopened or unfolded). The following United States patents are listed as examples of such containers, and other forms of previously known containers, and the disclosures of all such patents are fully incorporated herein by reference. See, for example, U.S. Pat. No. 921,197 to Zell: U.S. Pat. No. 1,150,105 to Emmons; U.S. Pat. No. 1,700,758 to Berkowitz; U.S. Pat. No. 2,151,472 to Hubbard; U.S. Pat. No. 2,721,022 to Billerbeck; U.S. Pat. No. 2,874,870 to Collura: U.S. Pat. No. 3,172,769 to Horan: U.S. Pat. No. 3,346,167 to Schmidt; U.S. Pat. No. 4,728,025 to Oliff; and U.S. Pat. No. 4,785,991 to Schuster.

Another previously known foldable container not represented in the above-noted U.S. patents is fully shown by present Prior Art FIGS. 1A and 1B. Prior Art FIG. 1A is a perspective view of a partially folded Prior Art disposable container 10. An integral blank of containerboard comprising such container may be folded between a relatively flat configuration and a set-up configuration. A pair of opposing side walls 12 and 14 may be folded along respective proximal edges 16 and 18 thereof at which they are attached to a bottom wall 20. A pair of opposing end walls 22 and 24 are similarly foldably attached to bottom wall 20. Four pairs of gusset pleats generally 26, 28, 30, and 32 interconnect adjacent edges of adjacent side and end walls so as to form a seamless container interior portion whenever such walls are raised into positions respectively perpendicular to bottom wall 20.

Referring now to Prior Art FIG. 1B, an elevational view of side wall 12 is illustrated from the interior of container 10 whenever such is in a set-up configuration. For the sake of clarity in illustrating certain wall locking features, side wall 12 is shown in dotted line, while folded walls 26 and 32 are shown in solid line. An additional folding wall or member 34 is also shown in dotted line. More specifically, folding member 34 is attached to side wall 12 at a fold line 36.

Wall 34 has a distal edge generally 38 which is separated into three elements or portions 40, 42, and 44. As shown in Prior Art FIG. 1B, members 40 and 44 project without folding whenever wall 34 is folded flat along fold line 36 down against folded walls 26 and 32. However, member 42 includes a further fold line 46 (shown in dotted line) along which member 42 is folded underneath walls 26 and 32 (i.e.. between side wall 12 and folded walls 26 and 32).

As illustrated in Prior Art FIG. 1B, such fold line 46 intersects (i.e.. engages) folded walls 26 and 32 at contact points 48 and 50, respectively. Opposite wall 52 is provided with similar features such that an elevational view of side wall 14 similar to that of Prior Art FIG. 1B would appear the same, except it would involve folded walls 28 and 30 in place of walls 26 and 32. The purpose of such contacts is to maintain disposable container 10 in its setup configuration. While achieving such purpose to a certain extent, the engagement contact provided is between a linear surface 46 and two single points 48 and 50, which provides for a limited degree of securement.

Also, a certain degree of dexterity is required to make the necessary folds and flap placements when assembling container 10 into its set-up configuration. Such relatively difficult operation may be exacerbated whenever the user (i.e., purchaser) is relatively unfamiliar with the product. Such may frequently be the case for a first time or an occasional user who purchases the product as an impulse decision, or out of short-term necessity, for use as an ice cooler or similar container for perishables or beverages to be transported.

With respect to closure and carriage, the Prior Art FIG. 1A container 10 includes foldable top walls 54 and 56 which incorporate punch-out cardboard handles 58 and 60 which respectively coordinate whenever walls 54 and 56 are folded flat across the top of the set-up container 10.

In order to hold top wall 56 in place (assuming that top wall 54 is folded into a closed position prior to the folding of wall 56), curved tabs 62 and 64 are formed in positions lateral to that of handle 60. As shown in Prior Art FIGS. 1A and 1B, corresponding openings 66 and 68 may be formed in the top of the set-up container 10 for receiving tabs 62 and 64, respectively. A fold line 70 (shown in dotted line) is formed in top wall 56 to facilitate introduction of tabs 62 and 64 into their respective slots 66 and 68. While effective to a certain degree for closing the interior of container 10, such top wall features generally contribute little relative to the overall stability and strength of the container 10.

The Prior Art container 10 of FIGS. 1A and 1B may also be provided with an interior surface coating of a moisture barrier nature, such as Curtain wax or the like. Such wax inner surface and seamless interior construction permits use of disposable container 10 as a disposable cooler.

Relatively smaller (i.e., portable) coolers are also otherwise known in the art, such as formed from insulated hard plastic or self-insulating styrofoam or like foamed plastic materials. Such designs generally are of a fixed form and may have a completely removable lid or a pivoting lid associated therewith. Due to relatively high initial cost, such portable coolers would not normally be regarded as being disposable.

SUMMARY OF THE INVENTION

The present invention recognizes and addresses various of the foregoing problems, and others, concerning disposable containers. Thus, broadly speaking, a principal object of this invention is providing an improved disposable container. More particularly, a main concern is providing an improved disposable cooler for transporting perishable materials or beverages with ice.

It is another particular object of the present invention to provide an improved disposable container which may be comprised of an integral blank of containerboard for folding between a relatively flat configuration for storage and a set-up configuration for receipt and transportation of articles therein. More specifically, it is a present object to provide such an improved disposable container which is both lightweight and strong, while also optionally being waterproofed for use as a disposable cooler. Another object is to provide such an improved container or cooler as the foregoing, and which may be alternately reversibly folded between its flat and set-up configurations, but without requiring any staples, tape, or glue (apart from the glue used to bond the multiple layers of any corrugated cardboard).

A further present object is to provide a disposable container foldable between flat and set-up configurations, which is also user-friendly as to folding operations. In other words, it is a present object to provide an improved foldable container which may be readily assembled (i.e.. folded) by the user into a set-up configuration, even whenever the user is not relatively familiar with the steps for assembling the container.

It is another present object to provide an integral blank of containerboard which may be foldable into a disposable container, while forming a relatively stable and strong closable container from such integral blank. It is also a present object to render such container reclosable after its initial opening, i.e., the closing process may be reversed and repeated without damage or detriment (beyond normal wear) to the container.

It is another present object to provide an improved disposable container which has specific wall locking features which are easy to assemble while providing a secure and strong construction. Another present object is the provision of improved top closure mechanisms which also contribute to the stability and strength of the disposable container while also being reclosable.

It is another present object to provide an integral blank of corrugated cardboard having adequate strength and water barrier coatings so as to structurally form when appropriately folded a self-locking insulated cooler for beverages, food related items, and other perishables, optionally packed with ice or the like. In such embodiments, it is intended that the disposable container be leak proof (i.e., moisture proof) at least a certain distance from the bottom of the cooler upward, even though the cooler is initially formed from an integral blank of containerboard which is initially folded into a relatively flat configuration for storage. It is a further particular object to provide such an improved disposable cooler which is available in a variety of sizes to hold more or fewer items, as desired, and to be optionally prepacked with desired items and enclosed in a plastic shrink wrap with exposed handles for carrying.

Additional objects and advantages of the invention are set forth in, or will be apparent to those of ordinary skill in the art from, the detailed description which follows. Also, it should be further appreciated that modifications and variations to the specifically illustrated and discussed features or materials hereof may be practiced in various embodiments and uses of this invention without departing from the spirit and scope thereof, by virtue of present reference thereto. Such variations may include, but are not limited to, substitution of equivalent means and features or materials for those shown or discussed, and the functional or positional reversal of various parts, features, or the like.

Still further, it is to be understood that different embodiments, as well as different presently preferred embodiments, of this invention may include various combinations or configurations of presently disclosed features, elements, or their equivalents, including combinations of features or configurations thereof not expressly shown in the figures or stated in the detailed description. One exemplary such embodiment of the present invention relates to a disposable container comprising an integral blank of containerboard for folding between a relatively flat configuration for storage thereof and a set-up configuration for receiving articles therein. Such integral blank may include a bottom wall, a pair of opposing side walls foldably attached along respective proximal edges thereof to the bottom wall, a pair of opposing end walls foldably attached along respective proximal edges thereof to the bottom wall and respectively interposed between the side walls about the periphery of such bottom wall, and four pairs of gusset pleats interconnecting adjacent edges of adjacent side and end walls so as to form a seamless container interior portion whenever the end and side walls are raised into set-up configuration respectively perpendicular to the bottom wall.

In the foregoing structure, planar slots are formed in accordance with this invention between the side walls and adjacent gusset pleats with longitudinal slotted openings thereto, first and second top walls are foldably attached along respective proximal edges thereof to respective distal edges of the end walls, handle means are associated with such first and second top walls for carrying of the disposable container, a locking panel is attached to a distal edge of one of the top walls so as to extend down at least a part of the exterior of an opposite end wall whenever the container is in its set-up configuration and the top walls are folded inwardly across the top of the container interior so as to close same, and a pair of locking tabs are carried respectively on opposite lateral edges of the locking panel so as to be removably received in respective of the planar slots passed through the slotted openings thereto. With such arrangement, the locking panel becomes positively locked with the one top wall across the top of the container interior so as to foldably form a relatively stable and strong closable container from the integral blank.

Another present exemplary embodiment concerns a disposable container comprising an integral blank of containerboard having generally as described above a bottom wall, a pair of opposing side walls foldably attached to the bottom wall, a pair of opposing end walls foldably attached to the bottom wall, and four pairs of interconnecting gusset pleats to form a seamless container in its set-up configuration.

In accordance with such another present exemplary embodiment, there is provided at least one top wall foldably attached to a distal edge of one of the end walls for closing the container interior, handle means associated with the first and second top walls for carrying of the disposable container, at least one first wall locking member received on each respective distal edge of the side walls, and at least one second wall locking member respectively operatively and removably associated with each first wall locking member in linear surface contact therewith for reversibly holding the container in its set-up configuration, each such second wall locking member being associated with one of the end walls and a pair of the gusset pleats interconnecting such end wall and the side wall associated therewith.

Yet another construction comprising a present exemplary embodiment includes a disposable self-locking insulated cooler for beverages and food related perishable items, comprising an integral blank of corrugated cardboard for folding between a relatively flat configuration for storage thereof and a set-up configuration for receiving articles therein, such integral blank including a moisture barrier coating on all interior facing surfaces of its set-up configuration.

The foregoing exemplary self-locking insulated cooler integral blank preferably further includes a bottom wall, a pair of opposing side walls foldably attached along respective proximal edges thereof to the bottom wall and having at least one first wall locking member received on each respective distal edge of the side walls, a pair of opposing end walls foldably attached along respective proximal edges thereof to the bottom wall and respectively interposed between the side walls about the periphery of the bottom wall, and four pairs of gusset pleats interconnecting adjacent edges of adjacent side and end walls so as to form a seamless cooler interior portion whenever the end and side walls are raised into set-up configuration respectively perpendicular to the bottom wall with planar slots formed between the side walls and adjacent gusset pleats with longitudinal slotted openings thereto.

Still further preferably included in such cooler integral blank are first and second top walls foldably attached along respective proximal edges thereof to respective distal edges of the end walls, handle means associated with the first and second top walls for carrying of the disposable cooler, at least one second wall locking member respectively operatively and removably associated with each the first wall locking member in linear surface contact therewith for reversibly holding the cooler in its set-up configuration, a closure locking panel attached to a distal edge of one of the top walls so as to extend down at least a part of the exterior of an opposite end wall whenever the cooler is in its set-up configuration and the top walls are folded inwardly across the top of the cooler interior so as to close same, and a pair of closure locking tabs carried respectively on opposite lateral edges of the closure locking panel so as to be removably received in respective of the planar slots passed through the slotted openings thereto, such that the closure locking panel becomes positively locked with the one top wall across the top of the cooler interior so as to foldably and reversibly form a closable disposable cooler from the integral blank.

Still another exemplary embodiment relates to a disposable insulated cooler, comprising an integral blank of corrugated containerboard reversibly foldable between a relatively flat configuration for storage thereof and a self-locking set-up configuration thereof with a moisture barrier coated interior for receiving perishables and ice therein. Such integral blank preferably includes a generally rectangular bottom wall having four side edges about the periphery thereof; first and second pairs of opposing generally rectangular side walls foldably attached along respective proximal edges thereof to the four side edges of the bottom wall; and four pleated walls foldably attached to adjacent edges between adjacent side walls, each having inwardly folding, diagonal central fold lines so as to form a seamless cooler interior portion with the bottom and side walls whenever the side walls are raised into setup configuration respectively perpendicular to the bottom wall, and with planar slots being formed between the side walls and folded adjacent pleated walls with longitudinal slotted openings thereto formed along the intersection of adjacent side wall lateral edges.

Still further included are first and second top walls foldably attached along respective proximal edges thereof to respective distal edges of the first pair of side walls; and handle means associated with the first and second top walls for carrying of the disposable cooler.

Other features preferably included are a first wall locking element foldably associated with the distal end of each one of the side walls of the second pair of side walls; and generally rectangular wall locking notches formed in each distal edge of the pleated walls which intersects a diagonal central fold line thereof, such notches being positioned for alignment with and receipt of an associated first wall locking element in linear surface contact therewith whenever the cooler is in its set-up configuration for locking such side walls in the set-up configuration.

Still further included are a closure locking panel foldably attached to a distal edge of one of the top walls so as to extend down at least a part of the exterior of an opposite side wall whenever the cooler is in its set-up configuration and the top walls are folded inwardly across the top of the cooler interior so as to close same; and a pair of closure locking tabs carried respectively on opposite lateral edges of the closure locking panel so as to be inserted into respective of the planar slots passed through the slotted openings thereto, such that the one top wall becomes positively locked across the top of the cooler interior by the closure locking panel so as to close the cooler.

Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

Figure 1A:
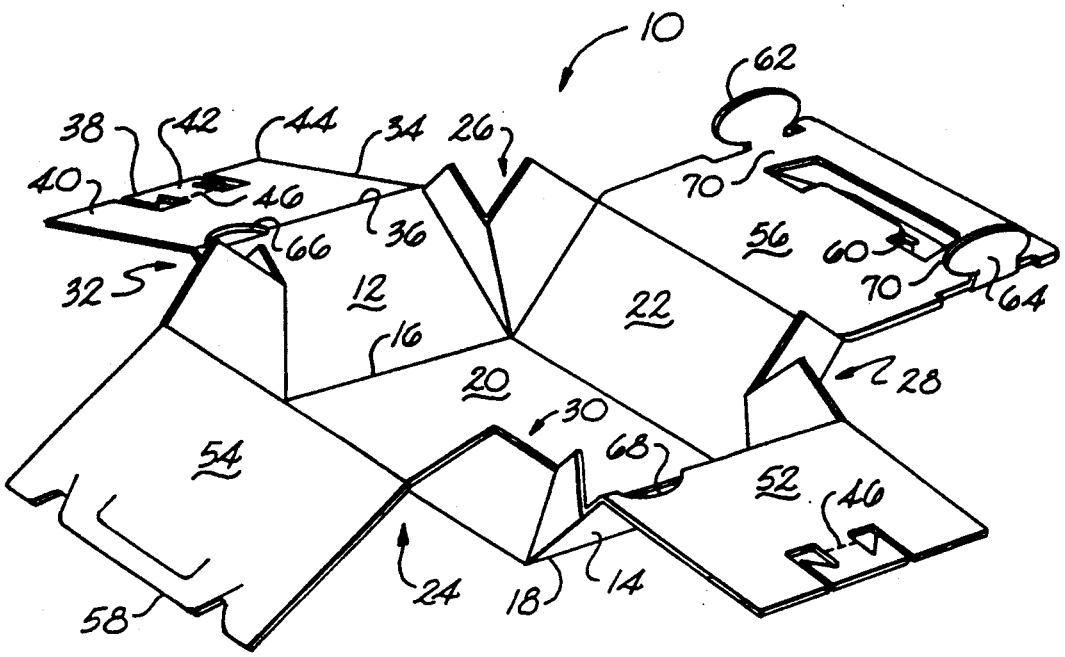
PRIOR ART Fig. 1A
FIG. 1A is an exemplary perspective view of a partially folded Prior Art container.

Repeat use of reference characters throughout the present specification and appended drawings is intended to represent same or analogous features or elements of the invention.

DETAILED DESCRIPTION OF THE PREFERRED EMBODIMENTS

Figure 1B:
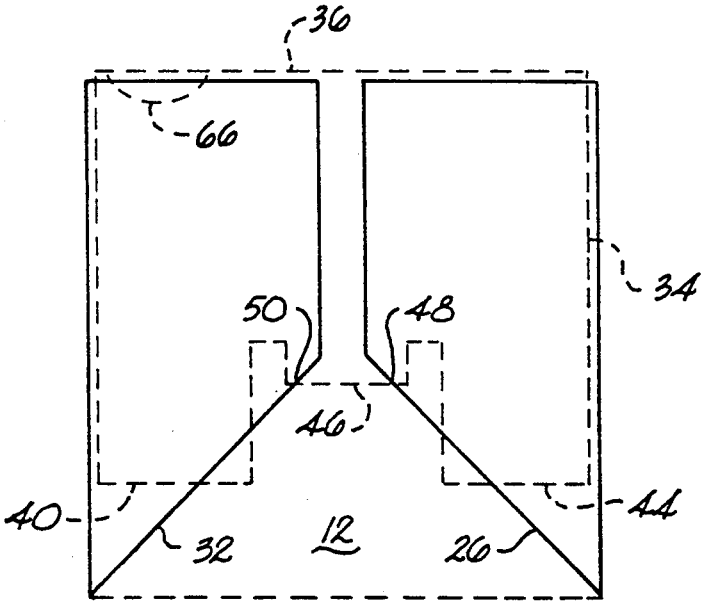
PRIOR ART Fig. 1B
FIG. 1B is an interior elevational view of a side wall and related features of the exemplary Prior Art container of FIG. 1A, in set-up configuration thereof.

FIGS. 1A and 1B relate to an exemplary Prior Art construction of a container 10, as discussed in detail above in the Background of the Invention. It will be understood that the remaining figures illustrate various features and embodiments in accordance with the subject invention, as discussed in greater detail hereinafter. During the course of such discussion, it is to be understood that the term proximal is used to refer to a near or adjacent side or edge, particularly one closer to the central portion of the container or the bottom wall thereof. At the same time, the term distal is intended as referring to a free or pivoted far end or edge of a wall (generally opposite to its proximal end), particularly one situated away from the central area of the container or the bottom wall thereof. Also, it will be understood that reference to a foldable attachment between two elements or members is intended as meaning that a fold line is established between such two members at the point or line of foldable attachment therebetween. Dotted line illustrations in the figures are generally intended to represent fold lines unless otherwise specified or understood from context to mean otherwise.

Figure 5:
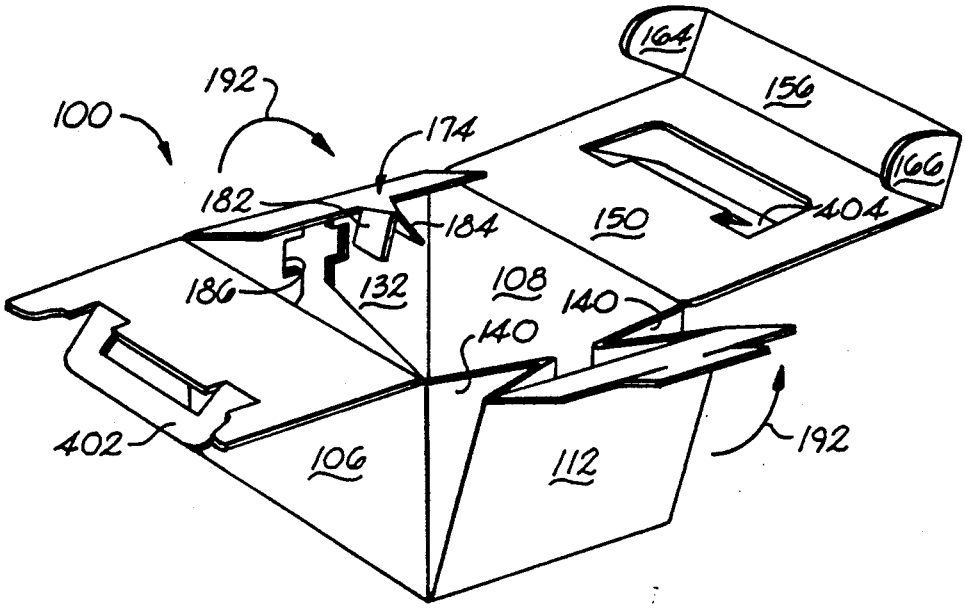
FIG. 5 is another perspective view of the embodiment of present FIGS. 2A, 3, and 4 further along in the progression of folding such embodiment into its set-up configuration.
Figure 6:
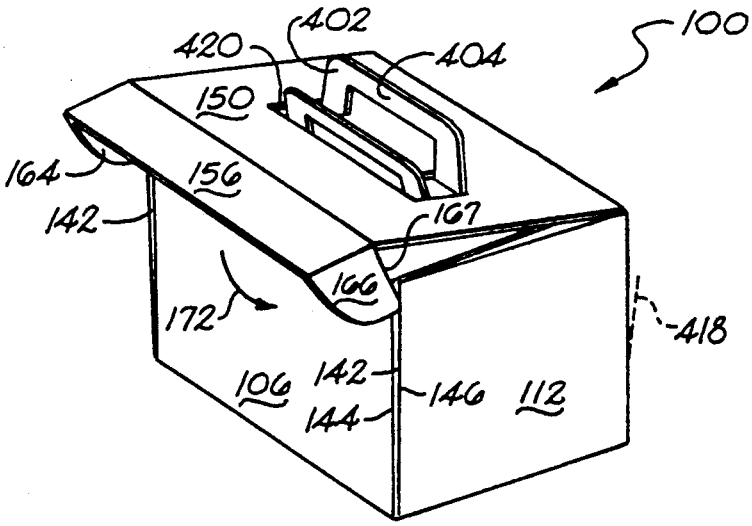
FIG. 6 is a perspective view showing the finalized set-up configuration of the present first exemplary embodiment of FIGS. 2A, 3, 4, and 5, and further illustrating closure (in progress) of the top closure locking features thereof.
Figure 7:
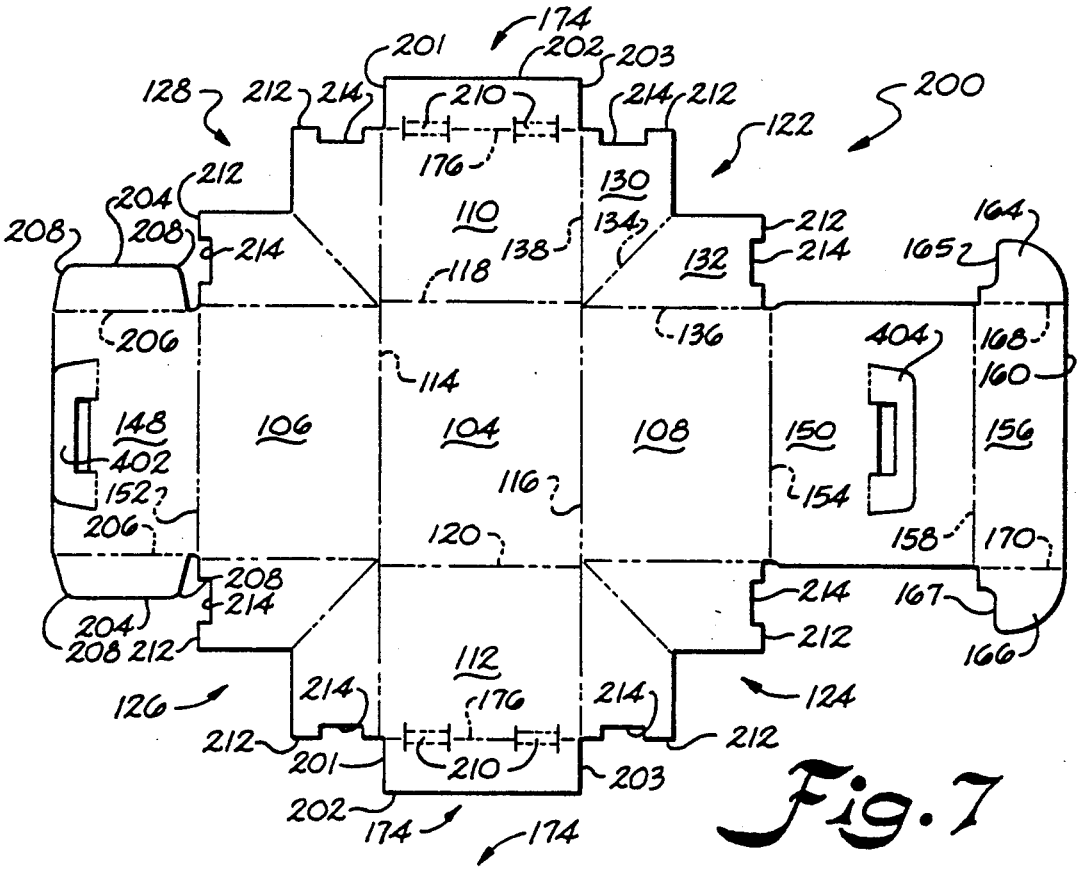
FIG. 7 is a top plan view of an integral blank comprising a foldable disposable container of a second exemplary embodiment of the subject invention.
Figure 8:
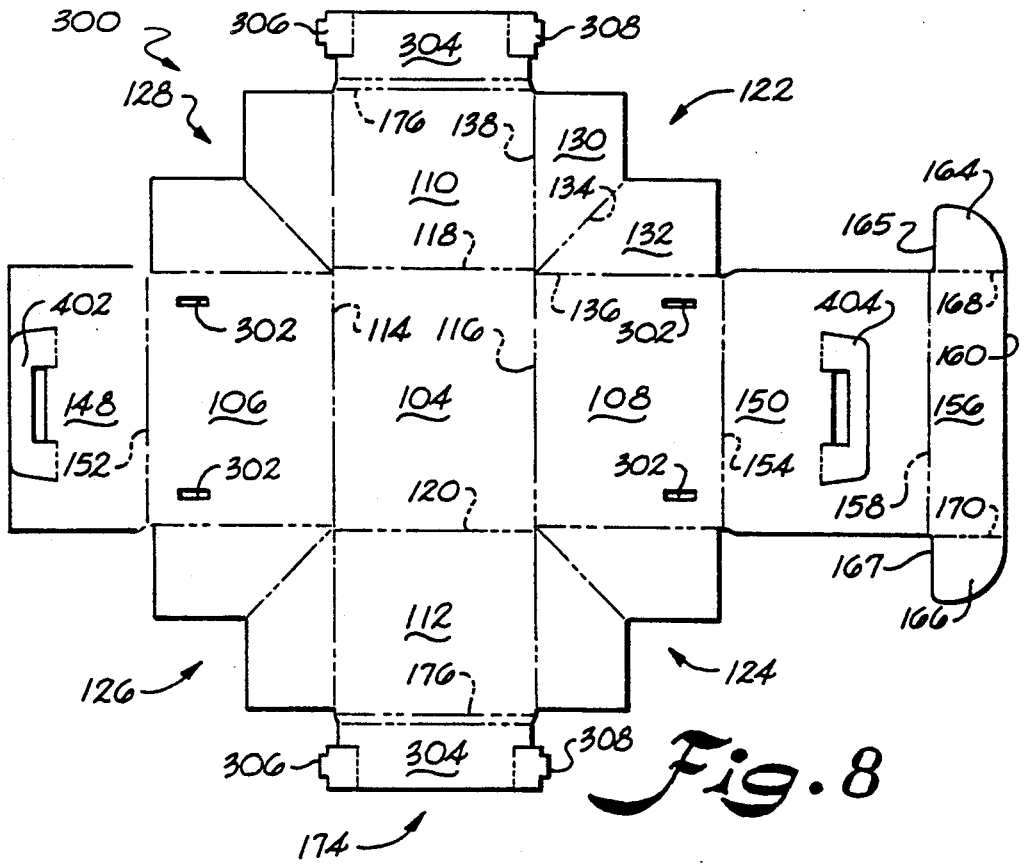
FIG. 8 is a top plan view of an integral blank comprising a foldable disposable container of a third exemplary embodiment in accordance with the subject invention.

Present FIGS. 2A through 6 represent a first embodiment of a disposable container 100 in accordance with the subject invention, while FIGS. 7 and 8 illustrate respective second and third embodiments of containers 200 and 300 in accordance with this invention.

Figure 2A:
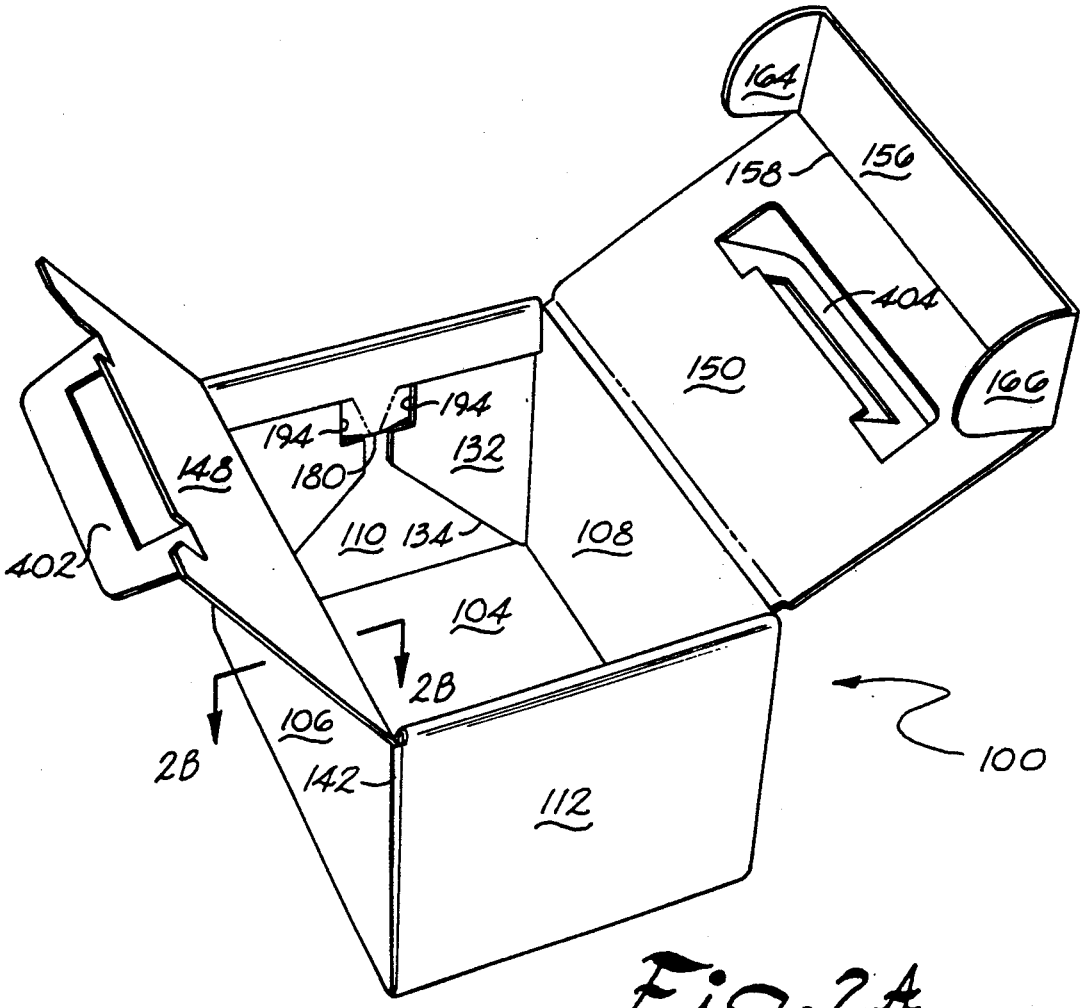
FIG. 2A is a perspective view of a first exemplary embodiment in accordance with the subject invention, in a set-up configuration thereof and with top closure panels in an open condition.
Figure 4:
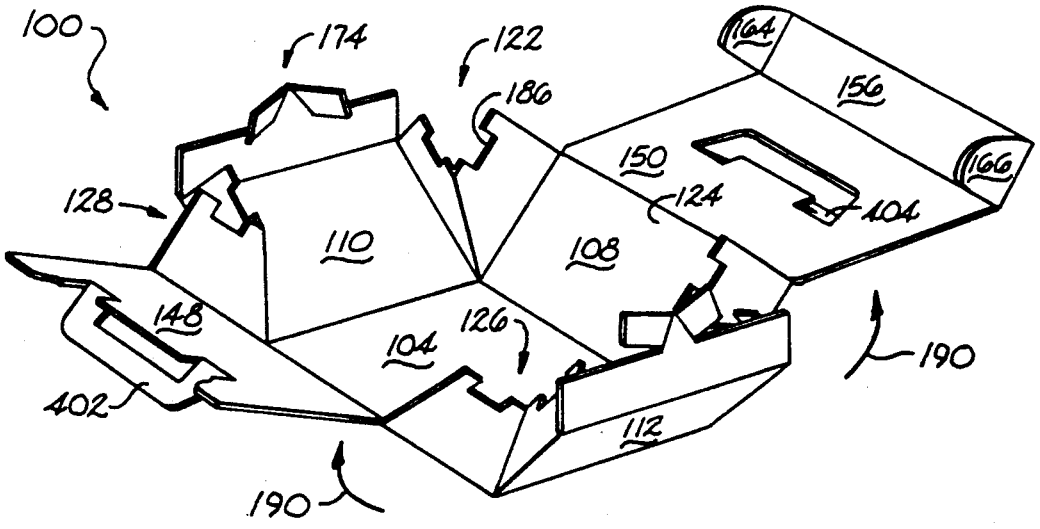
FIG. 4 is a perspective view of the present first exemplary embodiment of FIGS. 2A and 3, in a partially folded configuration thereof.

With reference to a first disposable container embodiment 100, FIGS. 2A, 4, 5, and 6 are perspective views of such container 100 in various folded (or partially folded) conditions or configurations thereof. Container 100 is in its set-up configuration in FIG. 2A, in which side walls thereof (walls foldably attached to a bottom wall) are respectively situated perpendicularly to such bottom wall. The top walls or top closures are open in the FIG. 2A illustration. In FIG. 4, the perspective view of container 100 illustrates a partially folded condition thereof, in which the side walls have been partially raised to approximately a 45 degree angle relative the plane in which the bottom wall resides. FIG. 5 is a perspective view of container 100 illustrating a near set-up configuration thereof, particularly useful for illustrating present wall locking features of such embodiment. FIG. 6 is a perspective view of container 100 illustrating a set-up configuration thereof, and particularly useful for illustrating certain top wall closure present features thereof.

Figure 3:
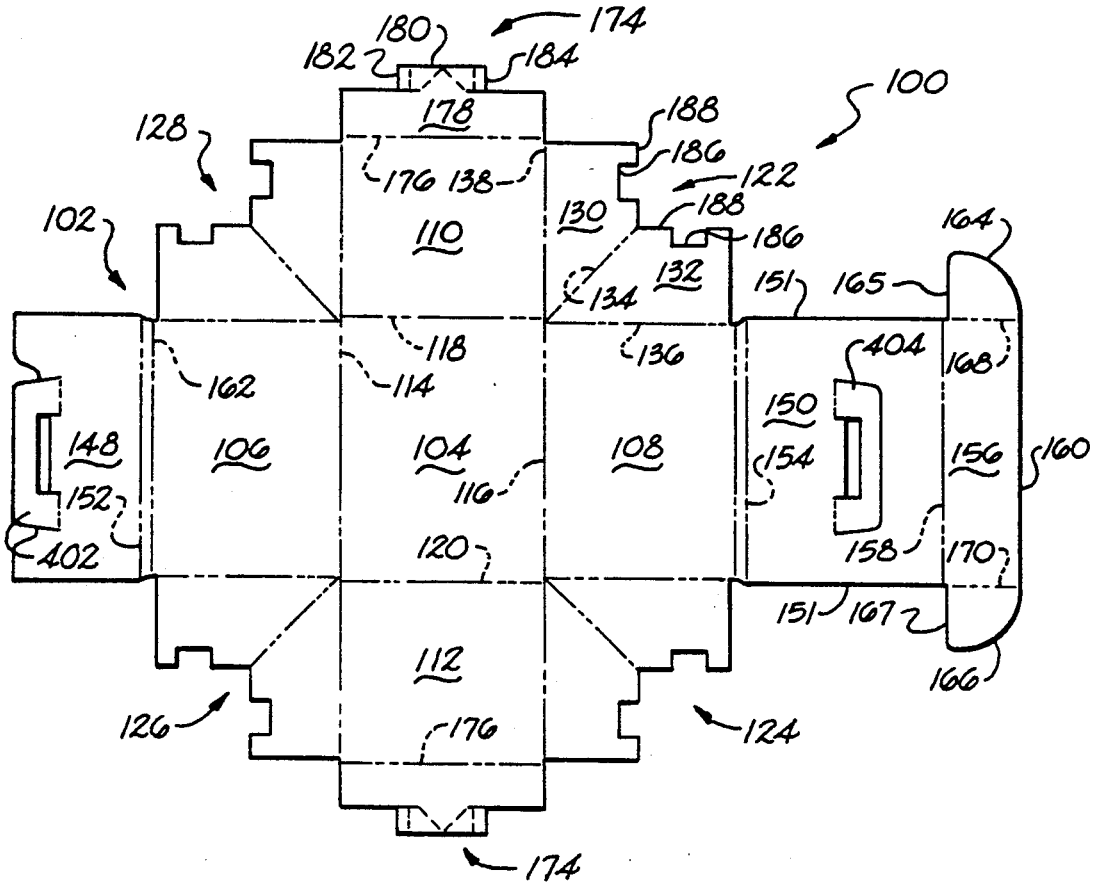
FIG. 3 is a top plan view of an integral blank comprising a foldable disposable container of a first exemplary embodiment represented in present FIG. 2A.

In comparison with the foregoing perspective views, FIG. 3 is a top plan view of container 100 foldably received in one relatively flat configuration thereof, such as advantageously may be used for storage or shipment of the container. Other relatively flat storage configurations thereof will be discussed in greater detail below.

FIGS. 7 and 8 are respective second and third exemplary containers 200 and 300, in top plan view. It is to be understood from the discussion herewith that such second and third embodiments may be folded and used in setup configurations as represented by present perspective view FIGS. 2A and 4 through 6. Hence, such perspective view figures are intended as representing such configurations and features of the alternate embodiments represented by present plan view FIGS. 7 and 8.

Now with reference to the first embodiment of disposable container 100, discussion follows herewith collectively concerning FIGS. 2A through 6.

Container 100 comprises a disposable container formed from an integral blank generally 102 which may be folded between a relatively flat configuration (FIG. 3) for storage thereof and a set-up configuration (FIGS. 2A and 6) for receiving articles therein. Integral blank 102 includes a generally rectangular bottom wall 104 which has four side edges about its periphery. First and second pairs of opposing generally rectangular side walls 106, 108, 110, and 112 are foldably attached along respective proximal edges 114, 116, 118, and 120 thereof to the four side edges of bottom wall 104. For purposes of present description, the first pair of side walls 106 and 108 may be regarded as comprising a pair of opposing end walls foldably attached along their respective proximal edges 114 and 116 to the bottom wall 104. Similarly, the second pair of side walls 110 and 112 may be regarded as comprising a pair of opposing side walls foldably attached on their respective proximal edges 118 and 120 to bottom wall 104, and respectively interposed between end walls 106 and 108 about the periphery of bottom wall 104.

Four pairs of gusset pleats or four pleated walls generally 122, 124, 126, and 128 are foldably attached to and interconnect adjacent edges of adjacent side (or side and end) walls along respective proximal edges thereof. More specifically, for example, pleated wall 122 includes respective gusset pleats 130 and 132 which are foldably joined to one another along an inwardly folding, diagonal central fold line 134. Pleated wall 122 is joined (again by fold lines shown in dotted lines) at its respective proximal edges 136 and 138 to walls 108 and 110, respectively. As will be understood by those of ordinary skill in the art from the disclosure herewith, such as represented in present FIG. 4, inward folding of walls 122, 124, 126, and 128 as container 100 is manipulated into its set-up configuration results in the two pairs of opposing walls 106, 108, 110, and 112 being raised to respective positions which are perpendicular to bottom wall 104. See, for example, FIGS. 2A and 6. For the sake of clarity in the figures, such particular features are labeled for only a single pleated wall 122, but those of ordinary skill in the art will appreciate that the corresponding description and function for the other pleated walls 124, 126, and 128 is the same.

With reference to FIGS. 5 and 6, it will be further understood to those of ordinary skill in the art from the present disclosure that a plurality of planar slots (generally 140) are formed between the side walls and between the folded adjacent pleated walls whenever the side walls are raised into their set-up configuration. More specifically, the bellows or pleated portions of the gusset pleats which fold inwardly define between their respective members (such as members 130 and 132) the above-referenced planar slots 140. Hence, an individual or respective planar slot 140 is formed at each pleated wall, which means that the present exemplary embodiments would have four such planar slots formed. However, two such planar slots (and perhaps one in some embodiments) are adequate for satisfying present purposes and functions, as discussed hereinbelow.

As further represented by present FIG. 6, longitudinal slotted openings 142 are formed along the intersection of adjacent side wall lateral edges (for example 144 and 146) as entrance ways to the respective planar slots 140. The purpose of such openings and the usefulness thereof will be discussed hereinafter.

Embodiments in accordance with the present invention may include various forms of one or more closure elements for closing the top of a container interior, the remaining features of such container being formed and otherwise provided in accordance with the subject invention. Moreover, certain embodiments of the present invention may include and incorporate therein top closure locking means in accordance with this invention for positive locking closure of the container interior. Present FIGS. 2A and 3 through 6 provide one exemplary embodiment of such top closure locking means as may be optionally utilized in accordance with the present first embodiment of this invention, and optionally utilized with second and third embodiments thereof as discussed below with reference to present FIGS. 7 and 8. It is to be understood that certain embodiments of the present invention may make use of other types of top closures, such as that illustrated and discussed in conjunction with panel 56 of present Prior Art FIG. 1A, though use of the following present top closure locking means features is generally preferred for most present embodiments.

First, the above-mentioned top closure locking means in accordance with this invention may include the plurality of planar slots 140 as discussed above, including the longitudinal slotted openings 142 thereto. In addition, such top closure locking means may further include two top walls 148 and 150 foldably attached along respective edges 152 and 154 thereof to respective distal edges of end walls 106 and 108 (i.e., those edges of walls 106 and 108 which are opposite to respective proximal edges 114 and 116 thereof).

Still further, such top closure locking means in accordance with this invention may include a locking panel 156 attached (preferably foldably) to a distal edge 158 of one of the top walls, such as top wall 150. As illustrated such as in present FIG. 6, the position of such locking panel 156 is situated and its size predetermined so that the locking panel will extend down at least a part of the exterior of an opposite end wall 106 whenever container 100 is being secured in the set-up configuration thereof. While various dimensions may be incorporated into different present embodiments, preferably locking panel 156 extends at least down about 25 percent of the opposite wall 106. In other words, the distance between edges 158 and 160 of locking panel 156 is preferably generally at least about 25 percent (or greater) of the distance between edges 114 and 162 of panel 106. Some present embodiments may use a lower percentage, so long as wall 150 and panel 156 are generally secured in accordance with this invention as discussed hereafter.

Still further, the above-referenced top closure locking means in accordance with this invention may include a pair of locking tabs 164 and 166 carried respectively on opposite lateral edges 168 and 170 of locking panel 156 so as to be received in respective of the planar slots 140 passed through the slotted openings 142 thereto. In other words, as locking panel 156 is brought across the top of container 100 and moved in the direction of arrow 172 (see FIG. 6), and as locking tabs 164 and 166 are seated in slots 140 as noted above, the locking panel 156 becomes positively locked with the one top wall 150 across the top of the container interior so that such container may foldably form a self-locking closable container 100. In such context, closable indicates that it is also reclosable generally without detriment (aside from normal wear) after removal (i.e., withdrawal) of tabs 164 and 166 from slots 140.

The top plan view of FIG. 3 indicates a double score line fold 152 and 162 between adjacent edges of walls 106 and 148. A similar structure is illustrated between adjacent edges of walls 108 and 150. With such an arrangement, a further reduced size relatively flat configuration of container 100 may be obtained for alternative storage or shipping arrangements therefor. More particularly, again with reference to the top plan view of FIG. 3, all materials above fold line 118 may be folded inwardly towards bottom wall 104, while all materials below fold line 120 may then be folded inwardly towards bottom wall 104. During such, any foldable extended tabs should be folded as necessary to complete the folding so that the abovereferenced materials are relatively flat against bottom wall 104 and the first pair of walls (or end walls) 106 and 108. Thereafter, the double score line folds as noted above will permit wall 148 and wall 150 (with locking panel 156 attached thereto) to be folded inwardly over the top of the first folded materials. Therefore, another form of a relatively flat storage/shipment configuration is obtained in accordance with the subject invention. Such double score line features may alternatively be used at different foldable attachments within the integral blank, and may be used in other present embodiments.

Still further, while locking tabs 164 and 166 may assume various different shapes and configurations, it is generally preferred that each of such locking tabs have a substantially straight line free proximal edge (edges 165 and 167, respectively) which is formed perpendicularly to the lateral edge 151 of the one top wall 150 to which such tab is adjacent and to which the locking panel 156 is attached. With such arrangement, the free proximal edge (such as 167 of present FIG. 6) functions as a pivot means for drawing the one top wall 150 and locking panel 156 into a secure closure across the container interior top whenever the locking tabs 164 and 166 are received into the planar slots 140. Such function will be apparent from the interaction of exemplary edge 167 of present FIG. 6 and the top or upper limit of slotted opening 142.

While the foregoing discusses in detail various top closure locking means which may be alternatively used in various present embodiments, the following more particularly discusses and discloses various wall locking means which may be optionally used in various present embodiments for locking opposing walls in the set-up configuration of the container 100. Again with reference to the first exemplary embodiment container 100, such wall locking means preferably includes at least one first wall locking member generally 174 foldably received on each respective distal edge 176 of side walls 110 and 112. Such wall locking means also further includes at least one second wall locking member respectively operatively and removably associated with each first wall locking member in linear surface contact therewith so as to effect the desired locking arrangement, such as discussed hereinafter. Each such second wall locking member, generally speaking, is associated with either an end wall 106 or 108, or a pair of gusset pleats interconnecting such end wall and the side wall 110 or 112. Alternative such arrangements coming within the spirit and scope of the subject invention are discussed in particular detail with reference to the three alternate container embodiments 100, 200, and 300 herewith.

With reference to the embodiment represented by first exemplary container 100, a first wall locking member may comprise a foldable main rectangular member 178 having a folded extension 180 therefrom which in turn has opposing foldable lateral edge tabs 182 and 184 which project from extension 180 in opposite directions. Second wall locking members in accordance with such present exemplary embodiment may comprise a plurality of edge notches 186 formed in distal edges 188 of the gusset pleats or pleated walls 122, 124, 126, and 128. Such edge notches 186 are aligned in the pleated walls so as to form overlapping pairs of notches situated on respective opposite lateral sides of the first wall locking member folded extension 180 whenever the container 100 is in its set-up configuration. With such an arrangement the opposing foldable lateral edge tabs 182 and 184 may be received and seated in the overlapping pairs of notches 186 for locking the container 100 into its set-up configuration.

Referring more specifically to such wall locking means, the wall locking notches 186 are generally rectangular and formed in the distal edge 188 of the pleated walls which intersects the diagonal central fold line 134 thereof. As shown in the drawings, such notches are positioned for alignment with and receipt of the associated first wall locking element tabs 182 and 184 in linear surface contact therewith. By such is meant that a linear surface of the first wall locking member is engaged with a linear surface of the second wall locking engagement member, instead of being engaged with only one or two contact points such as discussed above in conjunction with Prior Art FIG. 1B and engagement points 48 and 50 thereof. Engagement of respective linear surfaces in accordance with this invention provides improved wall locking means.

The following provides a general overview of container assembly steps in accordance with the subject invention, i.e., the process by which an integral blank in accordance with the subject invention may be folded from a flat storage configuration thereof into a set-up configuration for receiving materials to be transported.

FIG. 3 illustrates a top plan view of the initial, fully unfolded flat configuration of container 100. Of course, an alternate, smaller flat folded configuration is discussed above, but would ordinarily not be the starting position for folding container 100 into its set-up configuration. FIG. 4 generally illustrates the next step, in which all four sides 106, 108, 110, and 112 are raised generally upwardly in the direction of arrows 190 towards respective positions which are fully perpendicular to the plane in which bottom wall 104 resides. Of course, such upward raising actually means that each side is pivoted along its respective fold lines 114, 116, 118, and 120.

FIG. 5 generally illustrates the next phase, which occurs after the sides are fully raised. More specifically, first wall locking member generally 174 (when utilized) is pivoted in the direction of arrow 192 towards the interior of the container 100. As shown in such FIG. 5, the distal edge notches 186 of the pleated walls have already been positioned so as to form the overlapping pairs of notches situated on respective opposite lateral sides of where the first wall locking member folded extension 180 will be positioned. Thereafter, the opposing lateral edge tabs 182 and 184 may be inserted into and seated in the overlapping notches in respective linear surface contact therewith, such as along linear surfaces 194 of FIG. 2A. Such an arrangement advantageously provides a secure and stable wall closure or wall locking function, while also satisfying and addressing desired improvements in the area of user-friendly assembly features.

Those of ordinary skill in the art will appreciate that certain repeating like reference characters have been omitted from their corresponding repeating features in the figures in order to improve clarity of the illustrations. For example, the reference character descriptions and indications relating to pleated walls 122, 124, 126, and 128 are primarily limited to exemplary pleated wall 122. Likewise, the detailed description of first wall locking member 174 is primarily with reference to wall 110, though the same description (and reference characters) may be applied to corresponding elements for the first wall locking member 174 associated with wall 112. Omission of certain redundant reference characters in such regard is likewise made in figures other than FIG.

3. See for example, present FIG. 4 omits many repeated reference characters in order to preserve clarity.

Referring now to FIG. 7, a second exemplary embodiment comprising a disposable container 200 is shown as a top plan view of an integral blank comprising such container. Like reference characters utilized in this embodiment (and in the third present embodiment represented by present FIG. 8) are represented by like reference characters as used in the discussion above concerning the first exemplary embodiment of container 100. It is to be noted that various alternatives may be practiced within such context. For example, the top closure locking means described above in detail may be utilized in conjunction with the embodiments of FIGS. 7 and 8 while preferably the wall locking means of such respective embodiments differ in specific details as discussed hereinafter. Detailed discussion of repeated elements from the earlier embodiment is generally omitted.

With reference to the FIG. 7 embodiment, the first wall locking member generally 174 may comprise a foldable main rectangular member 202 which is foldable in relation to such respective wall 110 or 112 along a fold line 176. Linear surface lateral edges 201 and 203 of member 202 are sized so as to generally make an interference type fit with the interior of container 200. Since member 202 folds down onto folded walls 122 and 128, such walls become trapped so as to contribute to securement of the container set-up configuration.

In such FIG. 7 embodiment, the second wall locking member of the wall locking means preferably comprises a generally rectangular member 204 foldably attached to each respective lateral edge 206 of a top wall 48. With such an arrangement, the second wall locking rectangular member 204 is foldably interfaced with the first wall locking member rectangular main member 202 whenever the container 200 is in its set-up configuration and the top wall 148 is folded for closing the container. In other words, members 202 and 204 interface with one another along linear surfaces by residing adjacent to wall 110, which further contributes to securement of the container set-up configuration.

More particularly with such FIG. 7 embodiment, the second wall locking element generally rectangular member 204 preferably has relatively rounded distal edges 208 to facilitate manufacture and manipulation of the flap or member 204 as it is tucked downwardly into the container interior and against the folded element 202.

More preferably, the container 200 further includes aligned locking slots 210 formed in the base fold line 176 of the first wall locking element main rectangular member 202, and as formed in distal edges 212 of the gusset pleats 122, 124, 126, and 128. Such slots 210 and the distal edge slots 214 are situated for mutual alignment whenever walls 106, 108, 110, and 112 are raised to their set-up configuration. Thereafter, the first and second wall locking elements may be interfaced as noted. It should be noted that the distal edges 212 of pleated walls 122, 124, 126, and 128 Which define the locking notches 214 are not the same distal edge portions of such pleated walls as in the embodiment of container FIG. 1 which defines notches 186 therein.

A third present embodiment is represented by present FIG. 8, in which the pleated walls generally 122, 124, 126, and 128 do not require any notches in any of their distal edges. Instead, a plurality of slots 302 are formed in indicated positions in respective pairs in the opposing walls 106 and 108. Such slots have a generally linear construction so as to provide linear surface engagement with first wall locking members in accordance with this invention, as discussed hereinafter. Such is also consistent with the similar linear surface locking features discussed above with respect to embodiments of containers 100 and 200.

More particularly, a first wall locking member generally 174 in accordance with the third embodiment of the container 300 comprises a foldable main rectangular member 304 having opposing foldable lateral edge tabs 306 and 308 which project from such member 304 in opposite directions. Second wall locking members in accordance with this embodiment comprise the respective locking slots 302, as noted above. One slot 302 is provided for each lateral edge tab (the two tabs 306 and two tabs 308) for the preferred total of four matching pairs of tabs and slots to be received in linear surface engagement. As illustrated in FIG. 8, such slots 302 are situated so as to receive and seat its respective lateral edge tab 306 or 308 whenever the container is in its set-up configuration, thereby locking the container in such configuration.

Various present embodiments may make use of and combine different features and elements illustrated herewith so as to form particular embodiments of the subject invention. For example, none of the score lines in present FIG. 7 are illustrated as constituting a double score line as shown in conjunction with distal edges of walls 106 and 108 of present FIG. 3. However, such features could be variously incorporated into different locations of such FIGS. 7 and 8 so as to accomplish the purposes and functions noted above. For example, double score lines are shown in conjunction with walls 110 and 112 in the present exemplary top plan view of FIG. 8.

Still further features may be practiced in common with each of the three embodiments. For example, handle means in accordance with this invention may comprise a pair of cardboard handle elements 402 and 404 respectively integrally formed in the first and second top walls 148 and 150. As is well known to those of ordinary skill in the art, such handle elements may comprise punch-out portions of such top walls, and may be variously folded into proper position for carrying of the respective containers 100, 200, or 300. It should be understood that alternative handle means may be practiced. For example, various plastic handle elements, such as with T-shaped ends, may be inserted into appropriate slots or apertures therefor formed in top walls 148 and 150. It may be expected that those of ordinary skill in the art may from time to time select different alternative handle means for practice in conjunction with various of the other features disclosed herewith, all of which is intended to come within the spirit and scope of the present invention.

Figure 2B:
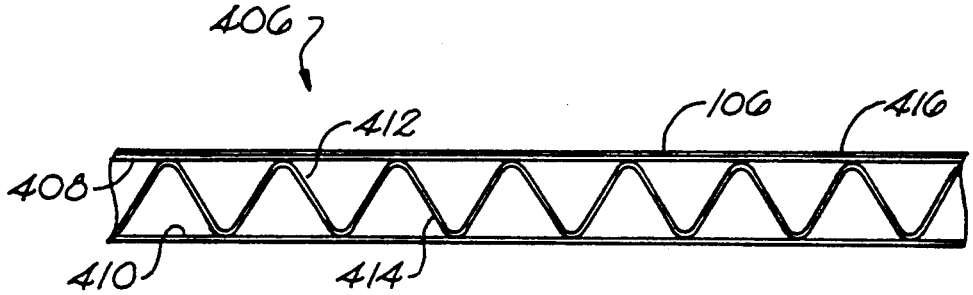
FIG. 2B is an enlarged cross-sectional view of a portion of a raised wall of the exemplary embodiment of the present invention as shown in FIG. 2A, taken along sectional line 2B—2B therein.

Still further features in accordance with this invention may be varied and/or practiced in common with the different embodiments thereof. For example, present FIG. 2B illustrates a cross sectional view of a portion of the wall 106 of present FIG. 2A of the first embodiment of container 100 in accordance with this invention. Such wall material may preferably comprise containerboard generally 406 constituting corrugated cardboard, formed of multiple layers of cardboard 408 and 410 glued together with a fluted layer of cardboard or a heavy gauge paper 412 therebetween. Most preferably, containerboard 406 comprises corrugated cardboard formed with moisture proof adhesive bonding holding together the various layers 408, 410, and 412.

Such corrugated cardboard preferably has a size C fluting 414, though different sized fluting may be practiced within the spirit and scope of this invention.

It is further preferred that a moisture proof coating 416 be applied to the interior surfaces of container 100 so as to form a self-locking disposable insulated cooler for storing perishables, beverages, and/or ice therein without leakage. Those of ordinary skill in the art will understand and appreciate that such coatings may comprise curtain wax coatings or other waterproof or moisture barrier coatings. Similarly, the corrugated cardboard may be wax impregnated throughout, or otherwise rendered moisture proof so as to function as the above-referenced interior surface moisture proof coating 416.

Still further, optional features may be practiced in accordance with the invention. For example, present FIG. 6 represents application of a plastic shrink wrap 418 to all exterior surfaces of the set-up configured container 100, except in the handle area 420 thereof. With such an arrangement, a container 100 could be sold in a setup configuration with goods, such as beverages and ice, already included therein. Plastic wrap enclosures are wellknown to those of ordinary skill in the art without discussion of additional details thereof, and would serve to further strengthen and waterproof the subject container.

Similarly, different logos, trademarks, or other decorations may be applied to the outside layer of the container, which may be practiced in white or off-white craft paper colors, rather than brown craft colors, which may be used for the interior.

Those of ordinary skill in the art will further appreciate that the present features of the subject invention may be practiced in accordance with different dimensional requirements or desires. For example, some preferred embodiments of the subject invention may be provided so as to result in an exterior length of generally within a range of from about 8 to about 14 inches, with an exterior width generally within a range of from about 6 to about 12 inches, and with an exterior height generally within a range of from about 6 to about 12 inches. With reference to the overall dimensions of exemplary blanks comprising a container 100 in accordance with the subject invention, with reference to the top plan view of present FIG. 3, an exemplary 12-pack beverage cooler may be comprised with an overall length (left to right dimension of present FIG. 3) of 46,375 inches and an overall width (the top to bottom dimension of present FIG. 3) of 35.625 inches. By comparison, a suitable size for an exemplary 6-pack beverage cooler in accordance with the top plan view of present FIG. 3 could be formed from an embodiment with a length of 39.125 inches and a width of 31.875 inches. The figures are not intended to be precise scale drawings, but do indicate to one of ordinary skill in the art the desired relative sizes, positions, and interactions of the different illustrated and discussed features thereof.

In the above-referenced 12-pack beverage cooler embodiment, while the distance between edges 158 and 160 of locking panel 156 may be about 3½inches, the distance between edges 114 and 162 of opposite end wall 106 may be about 8¾ inches. By ratio then, the locking panel would fold downward over approximately 40 percent of the outside or exterior of the opposite end panel when the container is fully assembled and closed. The 6-pack cooler example may be provided with a similar overlap percentage. As noted above, downward coverages of generally at least about 25 percent are desired, though variations may be practiced in given embodiments of the subject invention.

It should be further understood by those of ordinary skill in the art that the foregoing presently preferred embodiments are exemplary only, and that the attendant description thereof is likewise by way of words of example rather than words of limitation, and their use does not preclude inclusion of such modifications, variations, and/or additions to the present invention as would be readily apparent to one of ordinary skill in the art, the scope of the present invention being set forth in the appended claims.

What is claimed is:

1. A disposable container, comprising containerboard for folding between a relatively flat configuration for storage thereof and a set-up configuration for receiving articles therein, said container including a bottom wall, a pair of opposing side walls foldably attached along respective proximal edges thereof to said bottom wall, a pair of opposing end walls foldably attached along respective proximal edges thereof to said bottom wall and respectively interposed between said side walls about the periphery of said bottom wall, four pairs of gusset pleats interconnecting adjacent edges of adjacent side and end walls so as to form a seamless container interior portion whenever said end and side walls are raised into set-up configuration respectively perpendicular to said bottom wall, at least one top wall foldably attached to a distal edge of one of said end walls for closing said container interior, handle means associated with said at least one top wall for carrying of said disposable container, at least one first wall locking member received on each respective distal edge of said side walls, and at least one second wall locking member respectively operatively and removably associated with each first wall locking member in linear surface contact therewith for reversibly holding said container in said set-up configuration thereof, each said second wall locking member being associated with one of said end walls and a pair of said gusset pleats interconnecting said end wall and said side walls associated therewith; said container further including top closure locking means for positive locking closure of said container interior, w herein said top closure locking means includes planar slots formed between said side walls and adjacent gusset pleats whenever said container is in said set-up configuration thereof, and with longitudinal slotted openings thereto;

two top walls foldably attached along respective proximal edges thereof to respective distal edges of said end walls;

a locking panel attached to a distal edge of one of said top walls so as to extend down at least a part of the exterior of an opposite end wall whenever said container is in said set-up configuration thereof and said top wall are folded inwardly across the top of said container interior so as to close same; and a pair of locking tabs carried respectively on opposite lateral edges of said locking panel so as to be received in respective of said planar slots passed through said slotted openings thereto, such that said locking panel becomes positively locked with said one top wall across said top of said container interior so as to foldably form a self-locking closable container.

2. A disposable container as in claim 1, wherein:

said first wall locking member comprises a foldable main rectangular member with a folded extension therefrom having opposing foldable lateral edge tabs which project therefrom in opposite directions; and said second wall locking member comprises plural edge notches formed in distal edges of said gusset pleats and aligned therein so as to form overlapping pairs of notches situated on respective opposite lateral sides of said first wall locking member folded extension whenever said container is in said set-up configuration thereof, so that said opposing foldable lateral edge tabs may be received and seated in said pairs of notches for locking said container into its set-up configuration.

3. A disposable container as in claim 1, wherein:

said first wall locking member comprises a foldable main rectangular member having linear surface lateral edges which form an interference fit with the container interior; and said second wall locking member comprises a generally rectangular member foldably attached to a lateral edge of said at least one top wall, so that said second wall locking member is foldably interfaced with said first wall locking member whenever said container is in said set-up configuration thereof and said top wall is folded for closing said container.

4. A disposable container as in claim 3, wherein:

said second wall locking element generally rectangular member has relatively rounded distal edges; and wherein said container further includes aligned locking slots formed in a base fold line of said first wall locking element and in distal edges of said gusset pleats so as to further secure said second wall locking member therein whenever said container is in said set-up configuration thereof.

5. A disposable container as in claim 1 wherein:

said first wall locking member comprises a foldable main rectangular member having opposing foldable lateral edge tabs which project therefrom in opposite directions; and said second wall locking member comprises a respective locking slot for each lateral edge tab formed in said end walls and situated so as to receive and seat its respective lateral edge tab whenever said container is in said set-up configuration thereof for locking said container in its setup configuration.

6. A disposable self-locking insulated cooler for beverages and food related perishable items, comprising corrugated cardboard for folding between a relatively flat configuration for storage thereof and a set-up configuration for receiving articles therein, said cooler including a moisture barrier coating on all interior facing surfaces of its set-up configuration, a bottom wall, a pair of opposing side walls foldably attached along respective proximal edges thereof to said bottom wall and having at least one first wall locking member, received on each respective distal edge of said side walls, a pair of opposing end walls foldably attached along respective proximal edges thereof so said bottom wall and respectively interposed between said side walls about the periphery of said bottom wall, four pairs of gusset pleats interconnecting adjacent edges of adjacent side and end walls so as to form a seamless cooler interior portion whenever said end and side walls are raised into set-up configuration respectively perpendicular to said bottom wall with planar slots formed between said side walls and adjacent gusset pleats with longitudinal slotted openings thereto, first and second top walls foldably attached along respective proximal edges thereof to respective distal edges of said end walls, handle means associated with said first and second top walls for carrying of said disposable cooler, at least one second wall locking member respectively operatively and removably associated with each said first wall locking member in linear surface contact therewith for reversibly holdings said cooler in said set-up configuration thereof, a closure locking panel attached to a distal edge of one of said top walls so as to extend down at least a part of the exterior of an opposite end wall whenever said cooler is in said set-up configuration thereof and said top walls are folded inwardly across the top of said cooler interior so as to close same, and a pair of closure locking tabs carried respectively on opposite lateral edges of said closure locking panel so as to be removably received in respective of said planar slots passed through said slotted openings thereto, such that said closure locking panel becomes positively locked with said one top wall across said top of said cooler interior so as to foldably and reversibly form a closable disposable cooler from said relatively flat configuration thereof; wherein said cooler folded into said set-up configuration thereof has an exterior length generally within a range of from about 8 to about 14 inches, an exterior width generally within a range of from about 6 to about 12 inches, and an exterior height generally within a range of from about 6 to 12 inches;

said closure locking panel extends down at least 25 percent of said opposite end wall exterior;

said first wall locking member comprises a foldable main rectangular member with a folded extension therefrom having opposing foldable lateral edge tables which project therefrom in opposite directions; and said second wall locking member comprises plural edge notches formed in distal edges of said gusset pleats and aligned therein so as to form overlapping pairs of notches situated on respective opposite lateral sides of said first wall locking member folded extension whenever said cooler is in said set-up configuration thereof, so that said opposing foldable lateral edge tabs may be received and seated in said pair of notches for locking said cooler into its set-up configuration.

7. A disposable self-locking insulated cooler as in claim 6, wherein:

said corrugated cardboard has size C fluting; and said handle means comprise a pair of cardboard handle elements respectively integrally formed in said first and second top walls.

8. A disposable container as in claim 1, wherein said containerboard comprises corrugated cardboard formed with moisture proof adhesive bonding and with a moisture proof coating on interior surfaces of said container so as to form a self-locking disposable insulated cooler for storing perishables, beverages, and ice without leakage.

9. A disposable container as in claim 8, wherein:

said corrugated cardboard has size C fluting;

said at least one top wall includes two top walls foldably attached to respective distal edges of said end walls; and said handle means comprises a pair of cardboard handle elements respectively integrally formed in said two top walls;

10. A disposable self-locking insulated cooler as in claim 6, wherein said end walls are foldably attached to at least one wall adjacent thereto with a double score line fold so that said opposing side walls may be inwardly folded onto said bottom wall with other of said walls folded flat across said side walls whenever said cooler is folded into said relatively flat configuration thereof.

11. A disposable self-locking insulated cooler as in claim 6, further including plastic shrink wrap generally surrounding the exterior of said cooler whenever it is folded into said set-up configuration thereof with predetermined items to be carried received in the interior thereof.

12. A disposable insulated cooler, comprising corrugated containerboard reversibly foldable between a relatively flat configuration for storage thereof and a self-locking set-up configuration thereof with a moisture barrier coated interior for receiving perishables and ice therein, said cooler including:

a generally rectangular bottom wall having four side edges about the periphery thereof;

first and second pairs of opposing generally rectangular side walls foldably attached along respective proximal edges thereof to said four side edges of said bottom wall;

four pleated walls foldably attached to adjacent edges between adjacent side walls, each having inwardly folding, diagonal central fold lines so as to form a seamless cooler interior portion with said bottom and side walls whenever said side walls are raised into set-up configuration respectively perpendicular to said bottom wall, and with planar slots being formed between said side walls and folded adjacent pleated walls with longitudinal slotted openings thereto formed along the intersection of adjacent side wall lateral edges;

first and second top walls foldably attached along respective proximal edges thereof to respective distal edges of said first pair of side walls;

handle means associated with said first and second top walls for carrying of said disposable cooler;

a first wall locking element foldably associated with the distal end of each one of said side walls of said second pair of side walls;

generally rectangular wall locking notches formed in each distal edge of said pleated walls which intersects a diagonal central fold line thereof, said notches being positioned for alignment with and receipt of an associated first wall locking element in linear surface contact therewith whenever said cooler is in said set-up configuration thereof for locking said side walls in said set-up configuration;

closure locking panel foldably attached to a distal edge of one of said top walls so as to extend down at least a part of the exterior of an opposite side wall whenever said cooler is in said set-up configuration thereof and said top walls are folded inwardly across the top of said cooler interior so as to close same; and a pair of closure locking tabs carried respectively on opposite lateral edges of said closure locking panel so as to be inserted into respective of said planar slots passed through said slotted openings thereto, such that said one top wall becomes positively locked across said top of said cooler interior by said closure locking panel so as to close said cooler.

13. A disposable insulated cooler as in claim 12, wherein said cooler folded into said set-up configuration thereof has an exterior length generally within a range of from about 8 to about 14 inches, an exterior width generally within a range of from about 6 to about 12 inches, and an exterior height generally within a range of from about 6 to 12 inches.

14. A disposable insulated cooler as in claim 13, wherein:

said corrugated containerboard comprises cardboard having size C fluting; and said handle means comprise a pair of cardboard handle elements respectively integrally formed in said first and second top walls.

15. A disposable insulated cooler as in claim 13, wherein said closure locking panel extends down at least 25 percent of said opposite side wall exterior.

16. A disposable insulated cooler as in claim 15, wherein said closure locking tabs each have a substantially straight line free proximal edge formed perpendicularly to the lateral edge of said one top wall to which said closure locking panel is attached, so that said free proximal edge functions as a pivot means for drawing said one top wall and said closure locking panel into a secure closure across said cooler interior top whenever said closure locking tabs are inserted into said planar slots.

17. A disposable insulated cooler as in claim 15, wherein one pair of opposing side walls are respectively foldably attached to at least one wall adjacent thereto with a double score line fold so that the other pair of opposing side walls may be inwardly folded onto said bottom wall with other of said walls folded flat across said other pair of opposing side walls whenever said cooler is folded into said relatively flat configuration thereof.

18. A disposable insulated cooler as in claim 15, further including plastic shrink wrap generally surrounding the exterior of said cooler whenever it is folded into said set-up configuration thereof with predetermined items to be carried received in the interior thereof.

* * * * *